United States Patent [19]

Lahn et al.

[11] Patent Number: 4,780,921

[45] Date of Patent: Nov. 1, 1988

[54] COVER FOR THERAPEUTIC SUPPORT CUSHION

[76] Inventors: Karen R. Lahn, 323 Via Hidalgo, Greenbrae, Calif. 94904; Russell G. Ward, 942 E. 18th St., Eugene, Oreg. 97403

[21] Appl. No.: 35,770

[22] Filed: Apr. 8, 1987

[51] Int. Cl.[4] ..... A47C 20/02; A47G 9/02

[52] U.S. Cl. ..... 5/437; 5/441; 5/442; 5/490

[58] Field of Search ..... 5/420, 434, 436, 437, 5/441, 442, 490, 499, 500, 446, 464, 465, 480

[56] References Cited

U.S. PATENT DOCUMENTS

| | | | |
|---|---|---|---|
| 168,126 | 9/1875 | Barker | 5/442 |
| 2,460,452 | 2/1949 | Hampton | 5/490 |
| 2,500,974 | 3/1950 | Angert | 5/442 |
| 2,942,281 | 6/1960 | Cole | 5/442 X |
| 4,277,859 | 7/1981 | Seaman | 5/434 |
| 4,649,582 | 3/1987 | Cho | 5/437 X |

*Primary Examiner*—Michael F. Trettel
*Attorney, Agent, or Firm*—T. R. Zegree

[57] ABSTRACT

A resilient and stretchable cover for a therapeutic support cushion comprises an opening formed by detaching overlapping end portions of its top and bottom walls provided with an adhesive fastener tape secured thereto. The cover also includes a transversely disposed vertical partition comprising two overlapping detachably adherent sections, thereby forming two separate chambers, each adapted for accomodation of a support cushion.

14 Claims, 1 Drawing Sheet

COVER FOR THERAPEUTIC SUPPORT CUSHION

BACKGROUND OF THE INVENTION

This invention pertains to a cover for a therapeutic support cushion. More particularly, this invention relates to a protective cover for use in enclosing an inflatable supporting cushion therein.

As is well known, persons afflicted by pain or aches in various parts of the body, such as back, neck, shoulders, spine, pelvis, ischium, etc., as well as by ailments including headaches, arthritis, bursitis, are subjected to a discomfort caused by such functional disorders which are usually transmitted through the nervous system. Very frequently, such persons seek relief by positioning the ailing part of their body on a support, such as a pillow, a rolled up towel and the like props readily available in the house. Furthermore, in an attempt to provide a support having improved characteristics, various types of specially designed pillows or cushions have been described in the patent literature. Thus, U.S. Pat. No. 1,262,510 to Kelly discloses a pneumatic pillow having a ventilator within its casing. U.S. Pat. No. 2,521,780 to Dodd describes a pneumatic head rest or cushion especially useful to support the head and portions of the neck. U.S. Pat. No. 2,612,645 to Boland teaches an air cushion comprising an envelope having a plurality of upstanding partitions; U.S. Pat. No. 2,896,227 to Reed describes a contoured pillow having a cylindrical front core and a hexadral elongated rear core; U.S. Pat. No. 3,644,949 to Diamond discloses an air cushion containing several separately inflatable sections disposed one above the other; U.S. Pat. No. 4,528,705 to Greenawalt depicts a composite pillow made up of a sheet, the opposite ends of which are glued together and comprising an inflatable bag disposed within a large spherical end thereof; and U.S. Pat. No. 4,592,589 to Hellwig teaches an inflatable seat cushion having several communicating chambers separated by cross-pieces provided with openings for passage of air.

While the above-mentioned patents disclose the general concept of air-inflatable support pillows, the present invention provides a new approach to a structural form of a cover especially developed for use in conjunction with a therapeutic support cushion which offers certain advantages over the prior art devices.

OBJECTS OF THE INVENTION

In view of the foregoing, it is the principal object of the present invention to provide an improved cover specifically adapted for enclosing a therapeutic resilient cushion.

It is another object of the invention to provide a pliable cover of a novel structural design for use in combination with an inflatable orthopedic support cushion.

A further object of the invention is to provide a stress, pain or fatigue relieving assembly comprising a cover containing a support cushioning medium and being characterized by stretchability and adjustable resilience to satisfy the needs of individual users.

Still another object of the invention is the provision of a unitary elastic cover for a therapeutic support of the character described herein which can be manufactured in large quantities at a low cost from readily available materials.

These and other objects will become more fully apparent as the description of the present invention in its preferred embodiment proceeds in the following specification taken in conjunction with the accompanying drawing.

BRIEF SUMMARY OF THE INVENTION

In accordance with the invention, there is provided a flexible and adjustable cover for a therapeutic support cushion comprising a top wall, a bottom wall, a front wall, a rear wall and a pair of opposite side walls, a free end portion of said top wall extending under the free end portion of said bottom wall in overlapping relation, a detachable adhesive tape fastening means affixed transversely to the end portions of said bottom wall and said top wall for closing and opening said cover and a generally vertical partition formed by a pair of detachable sections inside said cover between said top wall and said bottom wall providing a pair of separate hollow chambers.

BRIEF DESCRIPTION OF THE DRAWING

In the accompanying drawing wherein like reference characters designate corresponding elements throughout the views thereof.

DETAILED DESCRIPTION OF THE INVENTION

Figure 1:
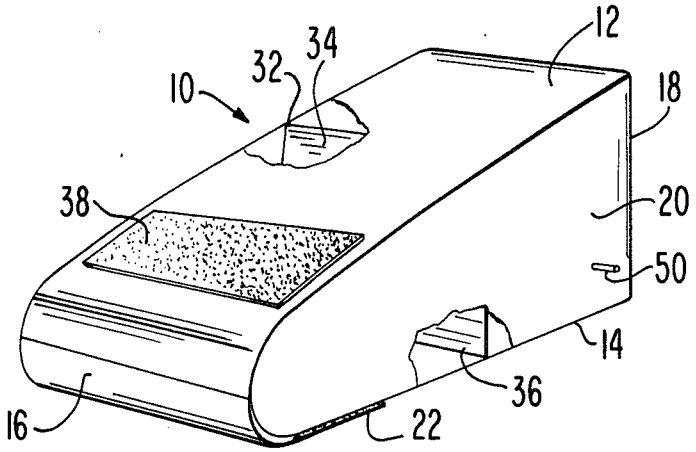
FIG. 1 is a perspective view of the cover enclosing an inflated cushion with portions broken away.
Figure 2:
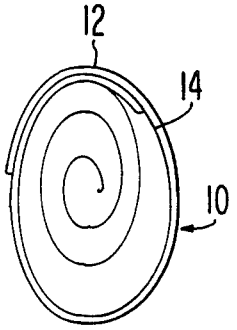
FIG. 2 is a side view of the empty cover of FIG. 1 in rolled up on itself and folded condition.
Figure 3:
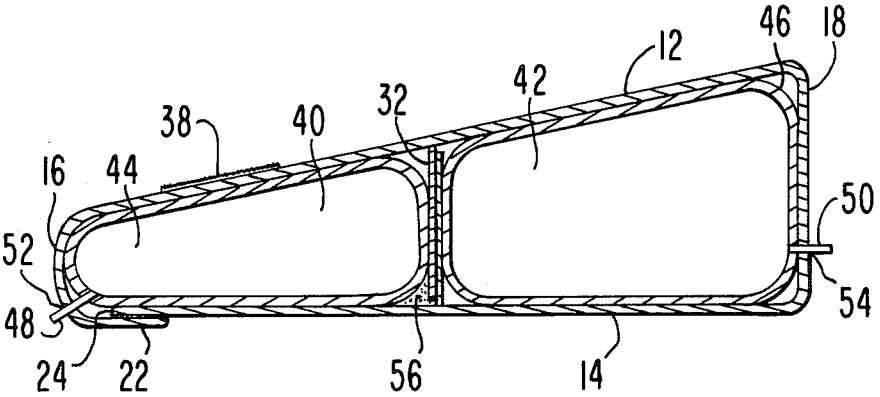
FIG. 3 is a cross-sectional view of the cover enclosing two inflated support cushions.

Referring now to the drawing, an elastic, stretchable and foldable cover 10 is illustrated in FIGS. 1 and 3 with a cushion in inflated condition. The cover comprises a horizontally elongated wedge-shaped casing including top wall 12 slanted downwardly from rear to front end, a horizontally disposed bottom wall 14, a relatively narrow front wall 16, a rear wall 18, the height of which is greater than that of front wall 16 and a pair of opposite side walls 20 of generally equal dimensions.

Figure 5:
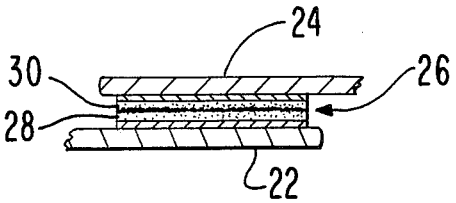
FIG. 5 is a fragmentary enlarged cross-sectional view of the bottom portion of the cover showing the fastening means in detail.

An important feature of the invention is that free end portion 22 of top wall 12 overlaps the free end 24 of bottom wall 14 as it extends over a relatively short distance underneath thereof, the inner surface of end portion 22 and the outer surface of end portion 24 being provided with a detachable adhesive tape fastening means 26 for easy opening and closing cover 10. The fastening means 26, referred to sometimes as hook-and-pile closure, comprises two strips of a suitable pliable adhesive tape fastener including a first adhesive fastener tape 28 secured to the inner surface of end portion 22 and a second cooperating adhesive fastener tape 30 secured to the outer surface of end portion 24, both tapes 28 and 30 being disposed transversely and substantially parallel to each other over substantially the entire width of each wall and attached by stitching or cementing adhesively or in any other suitable manner, as shown in FIG. 5. The exposed opposite adhesive surfaces of tapes 28 and 30 are releasably adherent to each other in a firm contact thereby producing a substantially air-tight seal between free end portions 22, 24 of both walls 12, 14. One type of an adhesive fastener tape which has been found satisfactory is a product sold commercially under the trademark "Velcro" and described in U.S. Pat. No. 3,414,033 to Tucker. Other similar adhesive fastening tapes capable of forming a strong but easily detachable bond therebetween are likewise satisfactory for use in the cover of the invention.

A third adhesive fastener tape 38 of the same character as tapes 28 and 30 is secured transversely to the outer surface of top wall 12 likewise by stitching or in any other suitable manner, the adhesive surface of the tape being exposed for adhesive engagement with the adhesive surface of tape 28 for closing or unfolding cover 10 when empty and rolled up on itself, as illustrated in FIG. 5, for convenient carrying or storage.

Figure 4:
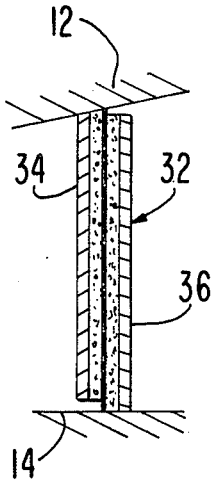
FIG. 4 is an enlarged cross-sectional view of the partition showing in detail two joined sections thereof.

Another important feature of the invention is a generally vertical partition 32 disposed transversely inside cover 10 across the entire width thereof between inner surfaces of top wall 12 and bottom wall 14. Partition 32 is constructed by a pair of adhesively coated sheets of the "Velcro" type described hereinabove or the like comprising the upper section 34 disposed downwardly and secured by stitching, sewing or by an adhesively detachable bond to inner surface of top wall 12, while the lower section 36 is disposed upwardly and affixed in a similar manner to inner surface of bottom wall 14. As shown in FIG. 4, the free end portion of lower section 36 is disposed in overlapping relationship with the free lower end portion of upper section 34, the two overlapping portions being joined in an easily detachable sealing engagement with each other, thereby producing a somewhat rigid and firm while at the same time a flexible vertical partition which forms within the cover 10 a pair of separate hollow chambers, i.e. front chamber 40 and rear chamber 42. While the specific location of partition 32 may be varied somewhat, it is preferred that both sections 34 and 36 be disposed generally in the center portion of cover 10 thereby forming two chambers of approximately the same length. As the area of the bond between the two cooperating surfaces of the adhesively coated sheets may be varied in the vertical plane upwardly or downwardly, the overall height of partition 32 can controllably be adjusted to provide a desired shape of the cover containing a supporting medium, thereby insuring maximum comfort to the user seeking relief in the painful area of the body. Sections 34 and 36 are preferably of equal length, however one section may be longer than the other provided that there is sufficient area to produce a firm bond therebetween.

In order to provide a complete therapeutic support including the cover of the present invention, a suitable support cushion is removably disposed within each chamber 40 and 42 by first inserting cushion 46 into rear chamber 42 through transversal opening in cover 10 across its width by detaching first fastener tape 28 from second fastener tape 30, passing cushion 46 through front chamber 40, then through an opening in partition 32 formed by detaching sections 34 and 36 from each other and finally inserting cushion 46 into chamber 42 and inflating the cushion to fill the cavity of the chamber substantially completely. Thereafter, second support cushion 44 is placed in front chamber 40 by inserting through opening in cover 10 formed between end portions 22 and 24 of the cover's walls and likewise inflated individually to a desired degree of firmness. A very satisfactory cushion adaptable for body support comprises an air-inflatable casing, such as a "sport-seat" marketed under the trademark "Thermarest", formed out of an air-tight, lightweight, flexible plastic or rubbery material and includes an attached thereto conventional air-lock valve 48 or 50 having an air inlet and outlet for inflating it to desired shape and deflating it when needed. As shown in FIG. 3, valves 48 and 50 project outwardly through small openings 52 and 54 provided in the walls of cover 10 for easy access thereto. It will be understood that each support cushion may be inflated to a degree sufficient to yield under the user's weight to give the desired support action. If desired, an inflated support cushion may optionally be supplemented by a lightweight, fluffy fibrous or particulate filling material 56 formed, for example, from cotton or synthetic foam which is distributed between the cushion and a cover's inner wall thereby enhancing the desired adjustable resilience of the assembly.

While the cover of the invention is preferably formed from a single sheet of a sturdy but stretchable plastic material having substantially uniform thickness and density, such as propylene film marketed under trademarks "Lycra" or "Spandex", other sheet materials having similar properties are likewise suitable for the manufacture of the cover. The cover may be produced in any suitable length or width to fit its desired use. Although the shape of cover 10 in empty condition may vary to a certain extent, it is preferred to provide a cover of substantially rectangular configuration.

While the cover has been described herein in its preferred embodiment comprising a pair of separate chambers, it is within the scope of the invention to provide a cover including three or more chambers separated by partitions of the construction described hereinabove. Moreover, the cover may be useful in enclosing other types of cushions, pillows, paddings and other support media.

It will be apparent from the foregoing description that we have devised an improved cover adapted for use in combination with a therapeutic support cushion. The cover is characterized by a substantially uniform density and elasticity throughout the body thereof and is particularly useful in combination with a support enclosed therein to patients in hospitals and other medical, orthopedic, ostheopatic or chiropractic centers, as well as to individual persons in their homes having chronic or injury-inflicted orthopedic problems by providing comfort and support to any part of their body, particularly the cervical area of the spine and ischial tuberosity bones. It is also useful as a preventive health care prop. Due to the specific arrangement of its adhesive tape fastening means, the cover offers flexibility in the variation of its configuration and its size when filled with an inflated support cushion thereby permitting its usefulness in supporting different areas of a person's body. A very important property of the cover assembled with a support is its inherent ability for adjustability to a desired operative position by varying areas of contact of the tape fasteners means. Furthermore, the structure of the partition composed of two detachable sections permits an easy insertion and removal of a support cushion. Such novel structural features of the cover of the invention render it highly suitable in combination with a support cushion in relieving pain, stress or tension in the afflicted regions of the body. Due to simplicity of its construction from a single sheet of material combined with strips of an adhesive tape fastener, the cover may be manufactured inexpensively in a large volume.

It will be understood that various modifications in the form or in the constructional details of our invention as herein described may be made without departing from the spirit thereof or the scope of the claims which follow.

We claim:

1. A flexible, adjustable cover for a therapeutic support cushion comprising a top wall, a bottom wall, a front wall, a rear wall, a front end and a rear end, a pair of opposite side walls, a free end portion of said top walls extending under a free end portion of said bottom wall in overlapping relation, a detachable adhesive tape fastening means affixed transversely to the end portions of said bottom wall and of said top wall for closing and opening said cover and a generally vertical partition formed by a pair of detachably adherent overlapping sections inside said cover between said top wall and said bottom wall providing a pair of separate hollow chambers, said sections comprising an upper section disposed downwardly and secured to inner surface of said top wall and a lower section disposed upwardly and secured to inner surface of said bottom wall, the overlapping portions of said sections being joined in a sealing engagement with each other.

2. The cover of claim 1, wherein said top wall is sloping toward the front end of said cover.

3. The cover of claim 1, wherein said fastening means comprises a first adhesive fastener tape secured to outer surface of said bottom wall and a cooperating second adhesive fastener tape secured to inner surface of said top wall and disposed substantially parallel to said first fastener tape.

4. The cover of claim 1, wherein a third adhesive tape fastener is secured transversely to the outer surface of said top wall for closing or opening said cover when said cover is empty.

5. The cover of claim 1, wherein the overlapping portions of said upper section and said lower section are disposed generally in the central portion of said partition.

6. The cover of claim 1 including a support cushion removably disposed within each of said chambers.

7. The cover of claim 6, wherein said support cushion is inflatable.

8. The cover of claim 6, wherein said support cushion is fitted with a valve for inflation thereof, said valve projecting through an opening in a wall of said cover.

9. The cover of claim 6, wherein said support cushion is supplemented by a lightweight particulate or fibrous filling material.

10. The cover of claim 1 formed of a single sheet of a stretchable plastic material.

11. The cover of claim 1, wherein said plastic material is polypropylene.

12. The cover of claim 1, wherein said cover is of a substantially rectangular configuration when empty.

13. In combination, a therapeutic support cushion enclosed in a chamber of the cover of claim 1.

14. An assembly of two air-inflatable support cushions disposed in two separate chambers of a cover defined in claim 1, said assembly having adjustable resiliency and capability to support an area of a person's body placed thereon.

* * * * *